US005172820A

United States Patent [19]

Daugherty, Jr.

[11] Patent Number: 5,172,820

[45] Date of Patent: Dec. 22, 1992

[54] FEMALE CONNECTION MEMBER USED IN AN ARTICULATED COUPLING ARRANGEMENT

[75] Inventor: David W. Daugherty, Jr., Bolingbrook, Ill.

[73] Assignee: Westinghouse Air Brake Company, Wilmerding, Pa.

[21] Appl. No.: 726,758

[22] Filed: Jul. 8, 1991

[51] Int. Cl.[5] ..... B61G 5/02

[52] U.S. Cl. ..... 213/75 R; 105/3

[58] Field of Search ..... 105/3, 4.1; 213/75 R, 213/151; 280/508, 514

[56] References Cited

U.S. PATENT DOCUMENTS

| | | | |
|---|---|---|---|
| 4,258,628 | 3/1981 | Altherr | 105/4 |
| 4,593,829 | 6/1986 | Altherr | 213/75 |
| 4,867,071 | 9/1989 | Weber | 105/4.1 |
| 5,042,393 | 8/1991 | Kanjo et al. | 105/3 |
| 5,065,679 | 11/1991 | Wallace et al. | 105/3 |
| 5,115,927 | 5/1992 | Wallace et al. | 213/75 R |

OTHER PUBLICATIONS

Maintenance Manual for ASF Articulated Connection Assembly, Nov. 1986.

*Primary Examiner*—Robert J. Oberleitner
*Assistant Examiner*—Kevin D. Rutherford
*Attorney, Agent, or Firm*—J. O. Ray, Jr.

[57] ABSTRACT

This invention provides a female connection member of an articulated coupling arrangement. Such female connection member includes a center sill engaging portion disposed adjacent a first end of such female connection member and a male connection member receiving portion disposed adjacent a readily disposed second end of such female connection member. A cavity having an open top portion and an open front portion is formed in such male connection member receiving portion. Such cavity is formed by a bottom wall portion, a pair of readily opposed side wall portions which extend upwardly from such bottom wall portion and a back wall portion also extending upwardly from the bottom wall portion and between such pair of side wall portions. A radially opposed opening is formed through each of such pair of side wall portions which opening includes an arcuate portion and a generally rectangular portion. Such female connection member has a generally round plate-like bolster bowl engaging portion disposed adjacent a bottom portion of the bottom wall portion of such cavity.

16 Claims, 1 Drawing Sheet

FEMALE CONNECTION MEMBER USED IN AN ARTICULATED COUPLING ARRANGEMENT

FIELD OF THE INVENTION

The present invention relates, in general, to railway car coupling arrangements and, more particularly, this invention relates to an improved female connection member which is formable as an integral single piece casting and which forms a portion of an articulated coupling arrangement used in connecting predetermined ends of a pair of adjacent railway cars together in a substantially semipermanent manner and which facilitates both assembly and disassembly of such articulated coupling arrangement.

CROSS REFERENCE TO RELATED APPLICATIONS

Co-pending applications relating to this application are U.S. patent application Ser. No. 520,581, filed May 8, 1990, U.S. Pat. No. 5,105,955 with the title of "Spherical Connector Apparatus in an Articulated Slackless-Type Coupler Arrangement Used in a Railway Application, U.S. patent application Ser. No. 520,686, filed May 8, 1990, U.S. Pat. No. 5,131,331 with the title of "Articulated Coupling Apparatus for Connecting Adjacent Ends of a Pair of Railway Cars", U.S. patent application Ser. No. 520,687, filed May 8, 1990, U.S. Pat. No. 5,065,679 with the title of "Articulated Coupling Apparatus for Connecting Adjacent Ends of a Pair of Railway Cars Together in a Semipermanent Manner", U.S. patent Application Ser. No. 521,861, filed May 8, 1990 with the title "Bearing Assembly for an Articulated Coupling Apparatus Which Connects Adjacent Ends of a Pair of Railway Cars Together", U.S. patent application Ser. No. 521,860, filed May 8, 1990, U.S. Pat. No. 5,042,393 with the title "Locking Assembly to Secure a Bearing Assembly in an Articulated Coupling Apparatus for Connecting Adjacent Ends of a Pair of Railway Cars, U.S. patent application Ser. No. 586,524, filed Sep. 21, 1990, abandoned with the title "Male Connection Member for an Articulated Coupling Arrangement", U.S. patent application Ser. No. 586,570, filed Sep. 21, 1990, U.S. Pat. No. 5,080,243 with the title "Assembly Mechanism for an Articulated Coupling System", U.S. patent application Ser. No. 586,511, filed Sep. 21, 1990, U.S. Pat. No. 5,115,927, U.S. patent application Ser. No. 588,578, filed Sep. 26, 1990, U.S. Pat. No. 5,139,159 with the title "Connecting Pin for Articulated Coupling Arrangement", U.S. patent application Ser. No. 588,454, filed Sep. 26, 1990, abandoned with the title "Locking Wedge Assembly to Removably Secure a Male Connection Member in an Articulated-Type Coupling Arrangement". Each of these patent applications is assigned to the assignees of the present invention and the disclosure contained therein is incorporated herein by reference thereto.

BACKGROUND OF THE INVENTION

In the railroad industry, it has been generally known, prior to the present invention, to use standard couplers that have been given prior approval for use by the Association of American Railroads (AAR). These standard couplers are used to connect adjacent ends of a pair of railway cars together. For example, in this application, such standard couplers were generally designed to facilitate both the connecting and disconnecting of individual railway cars forming a train consist. Such couplers enable these car to be readily and easily combined to make up the train consist or to be individually separated as necessary for loading and unloading purposes.

However, in more recent times, the railroad industry has discovered that the interconnecting of a number of railway cars together to form a substantially semipermanent unit has a number of important and distinct advantages. By way of example, these advantages are achieved when such railway cars are particularly designed for use in "piggy back" service and have been joined together in such semipermanent manner. Railway cars which have been joined in this semipermanent fashion are commonly referred to, in the railroad industry, as either a "five pack" or a "ten pack" unit. These particular units do not require the use of the standard AAR approved coupler discussed above, except between units. In other words, on the ends of such "five pack" or "ten pack" units. The principle reason such standard couplers ar not required in this application is because these units are only broken on a periodic basis. As a general rule, this occurs only when maintenance or replacement of an individual component must be carried out. Obviously, this enables considerable cost savings to be achieved with this arrangement. These cost savings are derived from lower weight, fewer railway trucks, reduced maintenance, and lower equipment cost. Such lower weight discussed above, as well as the reduced equipment cost which can be obtained, is achieved in part by the elimination of the need for draft gear assemblies in addition to the number of trucks required. It being understood that such draft gear assemblies are still required at each end of such "five pack" or "ten pack" units.

With the extended us of the semipermanent articulated coupler arrangements, and with the higher loads being carried by modern railway trucks, it is of the utmost importance that a close buttoned relationship be maintained between the draft components of the articulated coupling arrangement during in-track service. Such close buttoned relationship being required so that a reduction of the effects of the impact forces, which are normally encountered under buff conditions of train operations, can be achieved.

Taught in U.S. Pat. No. 4,258,628 is one of the prior art type of articulated coupling arrangements used for the purpose of connecting adjacent ends of a pair of railway cars together in a substantially semipermanent manner. This particular articulated coupling arrangement includes a male connection member secured at one end thereof to one end of a first railway car body member and a female connection member secured at one end thereof to an adjacent end of a second railway car body member. The female connection member, in this arrangement, is rotatably engaged in a center plate bowl portion of a bolster disposed on a railway car truck in a manner that is generally well recognized in the railway art. The outer end of the male connection member, in this prior art arrangement, is disposed for movement within a cavity that is formed in the outer end of such female connection member.

As illustrated in the drawings of this reference, both the male connection member and the female connection member are joined in a substantially semipermanent manner by a pin member. Such pin member is positioned in a vertical direction and is disposed in aligned apertures formed in each of the male connection member and the female connection member. It can =seen that the aperture formed in such male connection member for receiving the pin member therein must be somewhat larger than the pin member itself. Such larger aperture in the male connection member is required to achieve certain necessary movements of the articulated coupling arrangement. The rear surface portion of the aperture formed in the male connection member which receives such pin member therein has a horizontally disposed concave configuration and a vertically disposed convex configuration. This particular configuration enable both the male connection member and the female connection member to move in each of a horizontal direction and a vertical direction in relationship to one another, while at the same time, providing a relatively substantial area of surface contact between the rear surface, the pin member aperture, and the pin member.

The outer end surface of the outer end of the male connection member includes a convex configuration which abuts against a complimentary concave surface formed on a front face of a follower member. In this prior art articulated coupling device, the follower member is carried within the rear portion of the cavity formed in the outer end portion of the female connection member. This prior art device has a pair of vertically disposed slot-like cavities formed on the rear face of such follower member. Each of these vertical slots has a resilient element disposed therein. Such resilient element projects outwardly from the rear face of such follower member. The associated outer surface of each such resilient element is engaged by a vertically disposed wedge element. This wedge element is provided to urge the follower member and the male connection member forward. In this manner, the rear surface portion of the aperture formed in the male connection member will be maintained substantially in contact with such pin member at all times during operation.

This contact is necessary in these prior art articulated coupling arrangements because the majority of the articulated connecting parts are formed as cast members. Consequently, in order to reduce the cost of this coupling arrangement, such cast members will receive very little, if any, finished machining to provide the necessary or desirable dimensional control. As a result of this, it is rather difficult to provide an articulated coupling device which is self-adjusting under the various wear conditions which such coupling device will normally be subjected to during in-track service.

Other prior art articulated coupling devices are taught in U.S. Pat. No. 3,716,146 and Canadian Pat. No. 1,231,078.

SUMMARY OF THE INVENTION

The present invention provides an improved female connection member which forms a portion of an articulated coupling arrangement used in connecting predetermined ends of a pair of adjacent railway cars together in a substantially semipermanent manner.

The female connection member is formable as an integral single piece casting. Further, such improved female connection member is configured in a particular manner which will facilitate both assembly and disassembly of such articulated coupling arrangement. The improved female connection member includes a center sill engaging portion disposed adjacent a first end of the female connection member. This center sill engaging portion has a predetermined size and a predetermined configuration which includes a generally rectangular portion that enables the first end thereof to be engageable within such center sill so that the female connection member can be secured to one predetermined end of one of such pair of railway cars. The female connection member also includes a male connection member receiving portion disposed adjacent a radially disposed second end of such female connection member. A cavity having an open top portion and an open front portion is formed in such male connection member receiving portion. Such cavity is formed by a bottom wall portion, a pair of radially opposed side wall portions extending upwardly from the bottom wall portion, and a back wall portion extending upwardly from such bottom wall portion and between such pair of side wall portions. An inner vertically disposed surface of each of such pair of side wall portions has a predetermined configuration and such back wall portion of the cavity has a concave shape in each of a vertical direction and a horizontal direction. There is a radially opposed opening formed through each of such pair of side wall portions. Each opening has a predetermined configuration which at least includes an arcuate portion and a generally rectangular portion. Such rectangular portion of such opening terminates at an upper surface of a respective side wall portion. Such female connection member further includes a generally round plate-like bolster bowl engaging portion disposed adjacent a bottom portion of the bottom wall portion of such cavity formed in such male connection member receiving portion.

OBJECTS OF THE INVENTION

It is, therefore, one of the primary objects of the present invention to provide an improved female connection member which will facilitate both the assembly and the disassembly of such articulated coupling arrangement particularly when such coupling arrangement has been secured to a railway car.

Another object of the present invention is to provide an improved female connection member which is relatively inexpensive to produce.

Still another object of the present invention is to provide an improved female connection member which is relatively light weight.

A further object of the present invention is to provide an improved female connection member capable of withstanding in-track forces of up to 1,250,000 pounds forces being exerted thereon.

An additional object of the present invention is to provide an improved female connection member which can be readily installed within a center sill member on a new car or retrofitted to the center sill member of an existing railway car.

In addition to the above described objects and advantages of the improved female connection member of an articulated coupling arrangement, various other objects and advantage of the present invention will become more readily apparent to those persons who are skilled in the railway coupling art from the following, more detailed description particularly when such description is taken in conjunction with the attached drawing figures and with the appended claims.

BRIEF DESCRIPTION OF THE VARIOUS EMBODIMENTS OF THE INVENTION

Figure 1:
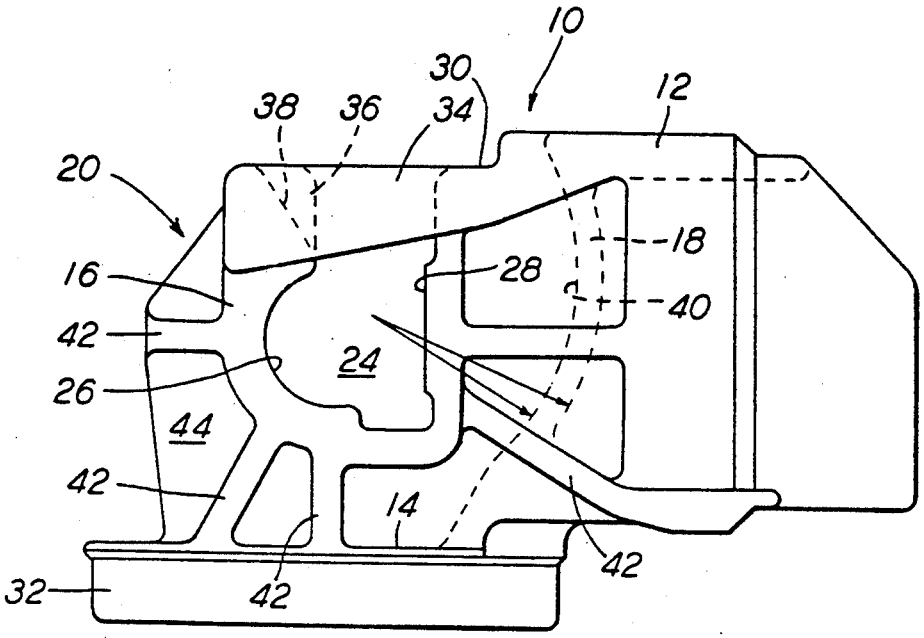
FIG. 1 is a side elevation view which illustrates a presently preferred vertically aligned configuration of a back wall portion of a female connection member constructed according to the present invention.

Prior to proceeding to the more detailed description of the improved female connection member produced according to the present invention, it should be noted that throughout the views illustrated in the attached drawings, identical components having identical functions have been identified by identical reference numerals for the sake of clarity.

Figure 2:
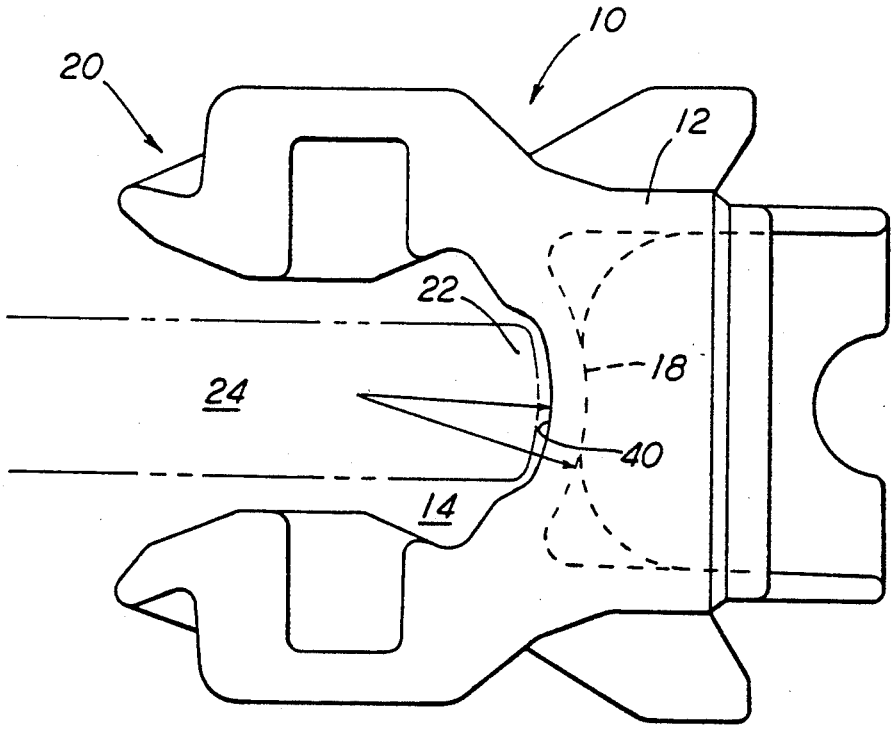
FIG. 2 is a top view which illustrates a presently preferred horizontal configuration of a back wall portion of a female connection member illustrated in FIG. 1.

Reference is now made to FIGS. 1 and 2. Illustrated therein is an improved female connection member generally designated 10. Such female connection member 10 is formable as an integral single piece casting, which forms a portion of an articulated coupling arrangement used for connecting predetermined ends of a pair of adjacent railway cars together in a substantially semi-permanent manner. Such improved female connection member 10 is configured in a particular manner which will facilitate both the assembly and disassembly of the articulated coupling arrangement.

The female connection member 10 includes a center sill engaging portion 12 disposed adjacent a first end of the female connection member 10. Such center sill engaging portion 12 has a predetermined size and a predetermined configuration which at least includes a generally rectangular portion that enables the first end of such female connection member 10 to be engageable within a center sill member (not shown) disposed along a longitudinal axis of the railway car (not shown). The predetermined configuration of such center sill engaging portion 12 is such that the female connection member 10 can be more readily secured to the end of one of such pair of railway cars.

Such female connection member 10 further includes a male connection member receiving portion, generally designated 20, disposed adjacent a radially disposed second end of such female connection member 10. A cavity is formed in such male connection member receiving portion 20. Such cavity is formed by a bottom wall portion 14, a pair of radially opposed side wall portions 16 which extend upwardly from such bottom wall portion 14 and a back wall portion 18 which also extends upwardly from such bottom wall portion 14 and between the pair of side wall portions 16. An inner vertically disposed surface of each of such pair of side wall portions 16 has a predetermined configuration. Such predetermined configuration enables the outermost end of the male connection member 22 to pivot in a horizontal direction of a range of at least about 10 degrees on either side of a longitudinal axis thereof, about a bearing assembly (not shown) disposed in an opening 24 formed through such outermost end of the male connection member 22. The back wall portion 18 of such cavity has a concave shape in each of a vertical direction and a horizontal direction. The purpose of this concave shape will become clear as the description of the present invention proceeds.

The female connection member 10 further includes a radially opposed opening 24 formed through each of the pair of side wall portions 16. Each opening 24 formed in the side wall portions 16 has a predetermined configuration which at least includes an arcuate portion 26 and a generally rectangular portion 28. Such rectangular portion 28 of the opening 24 terminates at an upper surface 30 of a respective side wall portion 16. The final essential element of the female connection member 10 is a generally round plate-like bolster bowl engaging portion 32 disposed adjacent a bottom portion of such bottom wall portion 14 of the cavity formed in such male connection member receiving portion 20.

In the presently preferred embodiment of the invention, such improved female connection member 10 further includes a strengthening member 34 connected to an outer surface 44 of each of such pair of side wall portions 16 adjacent the upper surface 30. Such strengthening member 34 is generally U-shaped in configuration to enable a shaft member (not shown) connected to the bearing assembly to be inserted through the generally rectangular portion 28 of the opening 24 into the female connection member 10 and, subsequently, engaged in the arcuate portion 26 of such opening 24. Preferably, the strengthening member 34 will be formed as a cast portion of such female connection member 10.

Also, in the presently preferred embodiment of the invention, the opening 24 formed through each of such pair of side wall portions 16 will include a generally triangular portion 36 disposed above the arcuate portion 26 and forwardly of such rectangular portion 28. The triangular portion 36 of such opening 24 has a tapered surface 38 which extends upwardly from an inner surface of such rectangular portion 28 and outwardly toward the upper surface 30 of a respective side wall portion 16. Such tapered surface 38 will preferably be inclined at an angle of between about 23.0 degrees and about 30.0 degrees. Such angle in the most preferred embodiment will be between about 24.5 degrees and about 27.0 degrees.

To facilitate the assembly and disassembly of such articulated coupling arrangement, an inner surface 40 of such concave shape of the back wall portion 18 in the vertical direction at a point of about 0.88 inch above which a horizontal plane that extends through a longitudinal axis of such shaft member engageable in such arcuate portion 26 of the opening 24 and at a point about 1.5 inches inwardly from a vertical plane extending through such longitudinal axis and toward such inner surface 40 of the back wall portion 18 and substantially midway between the inner vertically disposed surface of such pair of side wall portions 16 will have a radius of between about 6.95 inches and about 7.25 inches.

Additionally, the inner surface 40 of such concave shape of the back wall portion 18 in the horizontal direction at a point about 1.5 inches inwardly from a vertical plane extending through such longitudinal axis and toward such inner surface 40 of the back wall portion 18 and substantially midway between such inner vertically disposed surfaces of the pair of side wall portions 16 will have a radius of between about 6.95 inches and about 7.43 inches. It is presently preferred that such back wall portion 18 will have a thickness of generally about 1.0 inch. The concave shape discussed above in each of such vertical direction and such horizontal direction enables the nose portion of such male connection member 22 to be shifted inwardly toward such back wall portion 18 for a predetermined distance which is at least sufficient to enable easy assembly and disassembly of the articulated coupling arrangement. This distance will be at least about 1.5 inches and preferably about 2.0 inches.

In order to provide such female connection member 10, which preferably is a steel casting, the capability of withstanding forces of about 1.25 million pounds being exerted thereon, such pair of side wall portions 16 will include a plurality of reinforcing ribs 42 which extend outwardly from an outer surface 44 of such side wall portions 16.

While a number of presently preferred embodiments of the present invention have been described in considerable detail above, it should be obvious to those persons who are skilled in the railway coupling art that various modifications and adaptations of the improved female connection member can be made without departing from the spirit and scope of the appended claims.

We claim:

1. An improved female connection member formable as an integral single piece casting and which forms a portion of an articulated coupling arrangement used in connecting predetermined ends of a pair of adjacent railway cars together in a substantially semipermanent manner, said improved female connection member being configured in a particular manner which will facilitate both assembly and disassembly of such articulated coupling arrangement, said improved female connection member comprising:

(a) a center sill engaging portion disposed adjacent a first end of said improved female connection member, said center sill engaging portion having a predetermined size and a predetermined configuration which includes a generally rectangular portion that enables said first end to be engageable within such center sill so that said improved female connection member can be secured to one predetermined end of one of such pair of railway cars;

(b) a male connection member receiving portion disposed adjacent a radially disposed second end of said improved female connection member;

(c) a cavity having an open top portion and an open front portion formed in said male connection member receiving portion, said cavity formed by, (i) a bottom wall portion, (ii) a pair of radially opposed side wall portions extending upwardly from said bottom wall portion, an inner vertically disposed surface of each of said pair of side wall portions having a predetermined configuration, and (iii) a back wall portion extending upwardly from said bottom wall portion and between said pair of said side wall portions, said back wall portion of said cavity having a concave shape in each of a vertical direction and a horizontal direction;

(d) a radially opposed opening formed through said each of said pair of side wall portions, each said opening having a predetermined configuration which at least includes an arcuate portion and a generally rectangular portion and a generally triangular shaped portion disposed above said arcuate portion and forwardly of said rectangular portion, said rectangular portion of said opening terminates at an upper surface of a respective side wall portion, said triangular portion of said opening having a tapered surface which extends upwardly from an inner surface of said rectangular portion and outwardly toward said upper surface of said respective side wall portion; and (e) a generally round plate-like bolster bowl engaging portion disposed adjacent a bottom portion of said bottom wall portion of said cavity formed in said male connection member receiving portion.

2. An improved female connection member, according to claim 1, wherein said improved female connection member further includes a strengthening member connected to an outer surface of said each of said pair of side wall portions adjacent said upper surface.

3. An improved female connection member, according to claim 2, wherein said strengthening member is formed as a cast portion of said improved female connection member.

4. An improved female connection member, according to claim 1, wherein said tapered surface is inclined at an angle of between about 23.0 degrees and about 30.0 degrees.

5. An improved female connection member, according to claim 4, wherein said angle is between about 24.5 degrees and about 27.0 degrees.

6. An improved female connection member, according to claim 3, wherein is inclined at an angle of between about 24.5 degrees and about 27.0 degrees.

7. An improved female connection member, according to claim 1, wherein an inner surface of said concave shape of said back wall portion in said vertical direction at a point about 0.88 inch above a horizontal plane extending through a longitudinal axis of a shaft member engageable in said arcuate portion of said opening and a point about 1.50 inches inwardly from a vertical plane extending through such longitudinal axis and toward said inner surface of said back wall portion and substantially midway between said inner vertically disposed surface of said pair of side wall portions has a radius of between about 6.95 inches and about 7.25 inches.

8. An improved female connection member, according to claim 1, wherein an inner surface of said concave shape of said back wall portion in said horizontal direction at a point about 1.50 inches inwardly from a vertical plane extending through such longitudinal axis and toward said inner surface of said back wall portion and substantially midway between said inner vertically disposed surface of said pair of side wall portions has a radius of between about 6.95 inches and about 7.43 inches.

9. An improved female connection member, according to claim 6, wherein an inner surface of said concave shape of said back wall portion in said vertical direction at a point about 0.88 inch above a horizontal plane extending through a longitudinal axis of a shaft member engageable in said arcuate portion of said opening and a point about 1.50 inches inwardly from a vertical plane extending through such longitudinal axis and toward said inner surface of said back wall portion and substantially midway between said inner vertically disposed surface of said pair of side wall portions has a radius of between about 6.95 inches and about 7.25 inches and wherein an inner surface of said concave shape of said back wall portion in said horizontal direction at a point about 1.50 inches inwardly from a vertical plane extending through such longitudinal axis and toward said inner surface of said back wall portion and substantially midway between said inner vertically disposed surface of said pair of side wall portions has a radius of between about 6.95 inches and about 7.43 inches.

10. An improved female connection member, according to claim 1, wherein said back wall portion has a thickness of generally about 1.0 inch.

11. An improved female connection member, according to claim 1, wherein said concave shape in each of said vertical direction and said horizontal direction enables a nose portion of such male connection member to be shifted inwardly toward said back wall portion a predetermined distance.

12. An improved female connection member, according to claim 11, wherein said predetermined distance is at least about 1.5 inches.

13. An improved female connection member, according to claim 12, wherein said predetermined distance is at least about 2.0 inches.

14. An improved female connection member, according to claim 9, wherein said concave shape in each of said vertical direction and said horizontal direction enables a nose portion of such male connection member to be shifted inwardly toward said back wall portion for a distance of at least about 2.0 inches.

15. An improved female connection member, according to claim 1, wherein said each of said pair of side wall portions includes a plurality of reinforcing ribs extending outwardly from an outer surface thereof.

16. An improved female connection member, according to claim 1, wherein said improved female connection member is a steel casting capable of withstanding forces of about 1.25 million pounds being exerted thereon.

* * * * *

UNITED STATES PATENT AND TRADEMARK OFFICE

CERTIFICATE OF CORRECTION

PATENT NO. : 5,172,820

DATED : December 22, 1992

INVENTOR(S) : David W. Daugherty, Jr. et al.

It is certified that error appears in the above-identified patent and that said Letters Patent is hereby corrected as shown below:

Column 2, line 68, delete "=" and insert --be--.

Signed and Sealed this

Twenty-sixth Day of October, 1993

*Attest:*

Bruce Lehman

BRUCE LEHMAN

*Attesting Officer*

*Commissioner of Patents and Trademarks*